US010151288B2

(12) United States Patent
Horii

(10) Patent No.: US 10,151,288 B2
(45) Date of Patent: Dec. 11, 2018

(54) FUEL SUPPLY DEVICE

(71) Applicant: TOYOTA JIDOSHA KABUSHIKI KAISHA, Toyota-shi (JP)

(72) Inventor: Yuya Horii, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 176 days.

(21) Appl. No.: 15/144,154

(22) Filed: May 2, 2016

(65) Prior Publication Data

US 2016/0333840 A1 Nov. 17, 2016

(30) Foreign Application Priority Data

May 11, 2015 (JP) ..... 2015-096618

(51) Int. Cl.
*F02M 63/02* (2006.01)
*F02M 55/02* (2006.01)

(52) U.S. Cl.
CPC ..... *F02M 63/028* (2013.01); *F02M 55/025* (2013.01); *F02M 2200/26* (2013.01)

(58) Field of Classification Search
CPC .... F02M 63/028; F02M 55/025; F02M 55/02; F02M 61/14
See application file for complete search history.

(56) References Cited

U.S. PATENT DOCUMENTS 6,354,273 B1 * 3/2002 Imura ..... F02M 55/04 123/456
6,640,783 B2 * 11/2003 Braun ..... B29C 45/1642 123/456
7,028,668 B1 * 4/2006 West ..... F02M 55/025 123/456
7,438,053 B2 * 10/2008 Serizawa ..... F02M 55/025 123/456
2002/0108660 A1 * 8/2002 Braun ..... B29C 45/1642 138/30
2003/0221672 A1 * 12/2003 Zdroik ..... F02M 69/465 123/456
2004/0016418 A1 * 1/2004 Tsuchiya ..... F02M 55/025 123/456
2005/0257774 A1 * 11/2005 Usui ..... F02M 55/025 123/456

(Continued)

FOREIGN PATENT DOCUMENTS

CN 1824941 A 8/2006
CN 102066742 A 5/2011

(Continued)

*Primary Examiner* — Hung Q Nguyen
*Assistant Examiner* — Xiao Mo
(74) *Attorney, Agent, or Firm* — Oblon, McClelland, Maier & Neustadt, L.L.P.

(57) ABSTRACT

A fuel pipe of a fuel supply device includes: a first side wall having a mounting surface to which an injector cup and a bracket are attached; and a second side wall to which the injector cup and the bracket are not attached. A peripheral wall of the injector cup extends at least from a position on a bottom-end side relative to a centerline in a mounting surface to a position on an upper-end side relative to the centerline, and is fixed to the mounting surface at a part of the mounting surface on the bottom-end side relative to the centerline and at a part thereof on the upper-end side relative to the centerline.

6 Claims, 4 Drawing Sheets

(56) References Cited

U.S. PATENT DOCUMENTS

| | | | | |
|---|---|---|---|---|
| 2006/0137659 | A1 | 6/2006 | Zdroik et al. | |
| 2011/0108005 | A1* | 5/2011 | Nishizawa | F02M 55/025 123/469 |

FOREIGN PATENT DOCUMENTS

| | | | |
|---|---|---|---|
| JP | 2000-320422 | A | 11/2000 |
| JP | 2004-3422 | A | 1/2004 |
| JP | 2005-226516 | A | 8/2005 |
| JP | 2005-233085 | A | 9/2005 |
| JP | 2007-224914 | | 9/2007 |
| JP | 2007-255361 | | 10/2007 |
| JP | 2010-7651 | | 1/2010 |
| JP | 2011-132828 | | 7/2011 |
| JP | 2015-34533 | A | 2/2015 |
| WO | WO 2004/033894 | A1 | 4/2004 |

* cited by examiner

FUEL SUPPLY DEVICE

INCORPORATION BY REFERENCE

The disclosure of Japanese Patent Application No. 2015-096618 filed on May 11, 2015 including the specification, drawings and abstract is incorporated herein by reference in its entirety.

BACKGROUND

1. Technical Field

The present disclosure relates to a fuel supply device.

2. Description of Related Art

Japanese Patent Application Publication No. 2011-132828 (JP 2011-132828 A) describes a fuel supply device including a fuel pipe having a damper function to damp a fluctuation of a fuel pressure of an internal space, a tubular injector cup (socket) into which an injector is inserted, and a bracket for attaching the fuel pipe to an internal combustion engine. In the fuel supply device, the injector cup is attached to a bottom wall of the fuel pipe so that a central axis of the injector cup is perpendicular to the bottom wall of the fuel pipe. Further, since the bracket is fixed to the bottom wall of the fuel pipe, the bottom wall is reinforced so that the bottom wall is hard to bend.

SUMMARY

In the meantime, from structural restriction or the like of the internal combustion engine in which the fuel supply device is provided, the injector cup cannot be attached to the bottom wall of the fuel pipe in some cases. In such a case, the injector cup may be attached to a side wall of the fuel pipe so that a peripheral wall of the injector cup is along the side wall of the fuel pipe. Here, in the fuel supply device in which the injector cup is attached to the side wall, when a pressure of fuel in the fuel pipe increases and the fuel pipe deforms so as to project outward, the injector cup inclines along with the projection of the side wall. In such a case, a relative position between the injector cup and the injector inserted into the injector cup is changed, which may cause such a situation that a sealing characteristic of a sealing member provided between the injector cup and the injector decreases.

A fuel supply device that can restrain displacement of an injector cup even if the injector cup is attached to a side wall of a fuel pipe is provided.

According to an aspect of the present disclosure, a fuel supply device for an internal combustion engine is provided. The fuel supply device includes: a fuel pipe configured to lead, to an injector, fuel introduced into the fuel pipe; an injector cup into which the injector is inserted; and a bracket configured to fix the fuel pipe to the internal combustion engine. The injector cup includes a peripheral wall. The fuel pipe includes a first side wall and a second side wall. The first side wall includes a mounting surface to which the injector cup and the bracket are attached. The second side wall is configured such that the injector cup and the bracket are not attached. The second side wall is configured to elastically deform when a pressure of the fuel is applied to the second side wall. The mounting surface includes a first end, a second end, and a centerline. The first end and the second end are one end and its opposite end of the mounting surface in an axial direction of the injector cup. The centerline is a virtual line placed at a center between the first end and the second end. The injector cup is configured such that the peripheral wall extends at least from a position on a first-end side relative to the centerline in the mounting surface to a position on a second-end side relative to the centerline. The peripheral wall is fixed to the mounting surface at a part of the mounting surface on the first-end side relative to the centerline and at a part of the mounting surface on the second-end side relative to the centerline.

In a case where the fuel pressure inside the fuel pipe increases, a force to deform the first side wall and the second side wall is applied so as to swell them outward. Here, in a case where no member is attached to the first side wall, a central part of the first side wall, that is, a part corresponding to the centerline in the mounting surface easily swells largely due to the force. In this regard, in the above configuration, the injector cup extends at least from a position on a one-end side relative to the centerline in the mounting surface to a position on an other-end side relative to the centerline, and the peripheral wall of the injector cup is fixed to a part of the mounting surface on the one-end side relative to the centerline and a part thereof on the other-end side relative to the centerline. Accordingly, a part placed between a part of the first side wall on the one-end side and a part thereof on the other-end side is reinforced by the injector cup, so that the part placed therebetween does not easily deform. Here, the injector cup is fixed to the parts of the first side wall on the one-end side and the other-end side. As a result, it is possible to restrain the swelling of the central part, of the first side wall, which easily swells largely at the time when the fuel pressure inside the fuel pipe increases. Further, since the bracket is also attached to the mounting surface of the first side wall, it is possible to increase a rigidity of the part, in the first side wall, to which the bracket is fixed. This also makes it possible to restrain the deformation of the first side wall. Thus, according to the above configuration, since it is possible to restrain the deformation of the first side wall, it is possible to restrain displacement of the injector cup attached to the mounting surface of the first side wall.

Further, since the bracket and the injector cup are not attached to the second side wall, a rigidity of the second side wall is lower than in a case where the bracket and the injector cup are attached to the second side wall. Consequently, in a case where the fuel pressure inside the fuel pipe increases, the second side wall can deform so as to swell outward and can damp pulsation due to a pressure fluctuation of the fuel.

According to the above configuration, the peripheral wall of the injector cup extends on the mounting surface at least from a position closer to the second end than the centerline to the first end; and the peripheral wall is configured to be fixed to the mounting surface over a whole region of an abutment part of the peripheral wall with the mounting surface.

According to the above configuration, it is possible to increase a rigidity of a whole region where the peripheral wall of the injector cup abuts with the mounting surface. Hereby, even if the fuel pressure inside the fuel pipe increases, it is possible to further preferably restrain the first side wall from swelling outward. This accordingly makes it possible to further preferably restrain the displacement of the injector cup.

According to the above configuration, the bracket extends at least from a position on the first-end side relative to the centerline in the mounting surface to a position on the second-end side relative to the centerline; and the bracket is configured to be fixed to the mounting surface at a part of the mounting surface on the first-end side relative to the centerline and at a part of the mounting surface on the second-end side relative to the centerline.

According to the above configuration, the injector cup and the bracket are fixed to a part of the mounting surface on the one-end side relative to the centerline and a part thereof on the other-end side relative to the centerline. Accordingly, a part placed between a part of the first side wall on the one-end side and a part thereof on the other-end side is reinforced by the bracket, so that the part placed therebetween does not easily deform. Here, the bracket is fixed to the parts of the first side wall on the one-end side and the other-end side. As a result, it is possible to more preferably restrain the swelling of the central part, of the first side wall, which easily swells largely at the time when the fuel pressure inside the fuel pipe increases. Hereby, it is possible to more preferably restrain the displacement of the injector cup attached to the mounting surface of the first side wall.

According to the above configuration, the bracket extends at least from a position closer to the second end than the centerline in the mounting surface to the first end; and the bracket is configured to be fixed to the mounting surface over a whole abutment region of the bracket with the mounting surface.

According to the above configuration, it is possible to increase a rigidity of the whole abutment region of the bracket with the mounting surface. Hereby, even if the fuel pressure inside the fuel pipe increases, it is possible to further preferably restrain the first side wall from swelling outward. This accordingly makes it possible to further preferably restrain the displacement of the injector cup.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

The following describes one embodiment of a fuel supply device with reference to FIGS. 1 to 8. Note that, in the following description, directions such as an upper side, a lower side, and a lateral side are described on the basis of a state where the fuel supply device is attached to an internal combustion engine.

Figure 1:
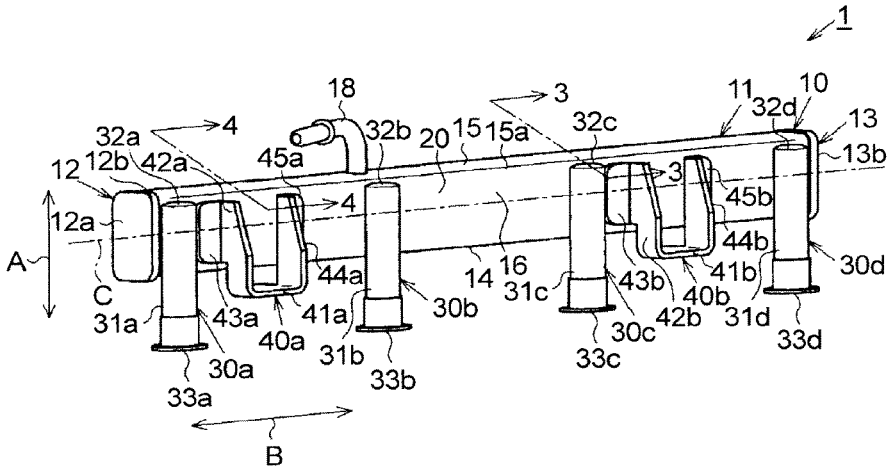
FIG. 1 is a perspective view of one embodiment of a fuel supply device.

As illustrated in FIG. 1, a fuel supply device 1 includes: a fuel pipe 10 for leading, to an injector, fuel introduced therein; four injector cups 30*a*, 30*b*, 30*c*, 30*d* into which respective injectors are inserted in a fixed manner; and two brackets 40*a*, 40*b* for attaching the fuel pipe 10 to an internal combustion engine. In the present embodiment, the fuel pipe 10, the four injector cups 30*a*, 30*b*, 30*c*, 30*d*, and the two brackets 40*a*, 40*b* are made of an iron material.

Figure 2:
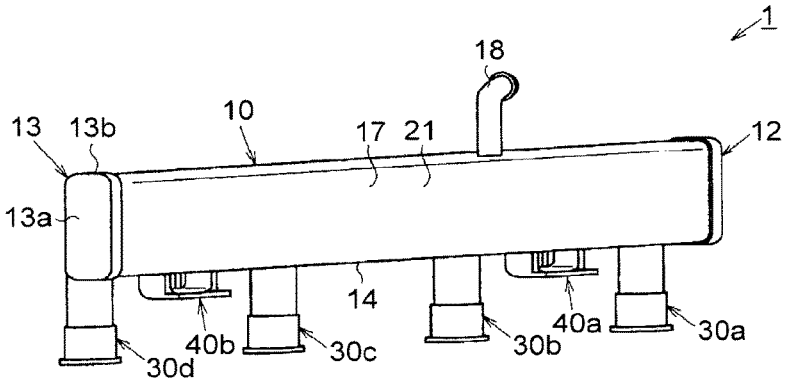
FIG. 2 is a perspective view of the fuel supply device of the embodiment.

As illustrated in FIGS. 1 and 2, the fuel pipe 10 is formed such that openings at both ends of a tubular member 11 having a generally rectangular-solid shape are closed by two caps 12, 13. The tubular member 11 is formed by pressing a cylinder.

Figure 3:
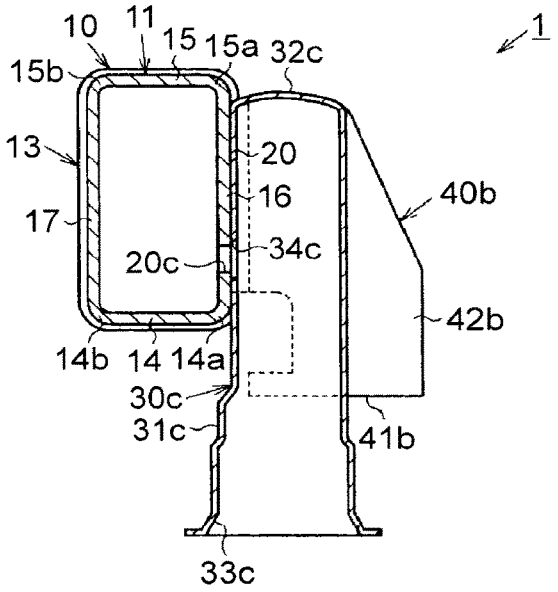
FIG. 3 is a sectional view taken along a line 3-3 in FIG. 1.
Figure 4:
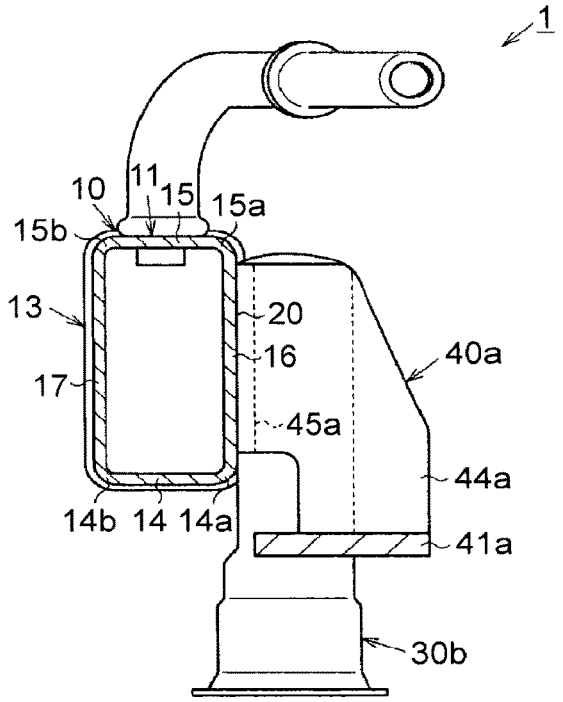
FIG. 4 is a sectional view taken along a line 4-4 in FIG. 1.

As illustrated in FIGS. 3 and 4, the tubular member 11 includes: a flat bottom wall 14 positioned at a lower side at the time when the tubular member 11 is attached to the internal combustion engine; two lower-side curved portions 14*a*, 14*b* curved continuously with both ends of the bottom wall 14; a flat upper wall 15 opposed to the bottom wall 14; and two upper-side curved portions 15*a*, 15*b* curved continuously with both ends of the upper wall 15. Further, the tubular member 11 includes a first side wall 16 and a second side wall 17. The first side wall 16 is a flat member that connects one lower-side curved portion 14*a* to one upper-side curved portion 15*a*. The second side wall 17 is a flat member that connects the other lower-side curved portion 14*b* to the other upper-side curved portion 15*b*. Further, the second side wall 17 is opposed to the first side wall 16.

Further, as illustrated in FIGS. 1 and 2, the cap 12, 13 includes a flat side wall portion 12*a*, 13*a*, and an outwardly-engaging portion 12*b*, 13*b* formed continuously with an outer edge of the side wall portion 12*a*, 13*a*. The cap 12, 13 is fixed to the tubular member 11 such that the outwardly-engaging portion 12*b*, 13*b* is outwardly engaged with an end portion of the tubular member 11 by brazing with copper. Further, as illustrated in FIG. 1, a fuel introduction tube 18 is connected to an upper wall 15 of the fuel pipe 10. Fuel is introduced into the fuel pipe 10 through the fuel introduction tube 18.

In the fuel pipe 10, the first side wall 16 and the second side wall 17 among flat side walls 12*a*, 13*a*, 14, 15, 16, 17 are side walls with a largest surface area exposed outside the fuel pipe 10. Further, in a state where the first side wall 16 and the second side wall 17 are provided in the internal combustion engine, their lateral length (in a direction indicated by an arrow B in FIG. 1) is longer than their vertical length (a direction indicated by an arrow A in FIG. 1). In the first side wall 16, four through-holes, i.e., first to fourth through-holes are formed at regular intervals from one end to the other end in a longitudinal direction. In the present embodiment, two brackets 40*a*, 40*b* are attached to a mounting surface 20, which is a surface of the first side wall 16, and first to fourth injector cups 30*a*, 30*b*, 30*c*, 30*d* are also attached thereto so as to correspond to the first to fourth through-holes of the mounting surface 20, respectively. That is, the first injector cup 30*a* is attached at a position corresponding to the first through-hole in the mounting surface 20, and the second injector cup 30*b* is attached at a position corresponding to the second through-hole. Further, the third injector cup 30*c* is attached at a position corresponding to the third through-hole in the mounting surface 20, and the fourth injector cup 30*d* is attached at a position corresponding to the fourth through-hole. Further, as illustrated in FIG. 2, no member is attached to a surface 21 of the second side wall 17.

As illustrated in FIGS. 1 and 3, the first to fourth injector cups 30*a*, 30*b*, 30*c*, 30*d* have a generally bottomed tubular shape. The first to fourth injector cups 30*a*, 30*b*, 30*c*, 30*d* include tubular peripheral walls 31*a*, 31*b*, 31*c*, 31*d*, closing portions 32*a*, 32*b*, 32*c*, 32*d* that close one ends of the peripheral walls 31*a*, 31*b*, 31*c*, 31*d*, and opening portions 33*a*, 33*b*, 33*c*, 33*d* that are opened in the other ends of the peripheral walls 31*a*, 31*b*, 31*c*, 31*d*. Each injector cup 30*a*, 30*b*, 30*c*, 30*d* is disposed such that its central axis extends in parallel with the first side wall 16. An axial length of the injector cup 30*a*, 30*b*, 30*c*, 30*d* is longer than the vertical length of the first side wall 16. Further, as illustrated in FIG. 3, the peripheral wall 31*c* of the third injector cup 30*c* has a through-hole 34*c* formed in a part near an axial center of the peripheral wall 31*c* and closer to the closing portion 32*c*. The peripheral wall 31*c* of the third injector cup 30*c* abuts with the mounting surface 20 so that the through-hole 34*c* is connected to the third through-hole 20*c* of the first side wall 16 of the fuel pipe 10. Similarly, the peripheral walls 31*a*, 31*b*, 31*d* of the first, second, and fourth injector cups 30*a*, 30*b*, 30*d* have respective through-holes, so that the through-holes are connected to the first, second, and fourth through-holes of the first side wall 16 of the fuel pipe 10, respectively. Hereby, an internal space of the fuel pipe 10 communicates with respective internal spaces of the injector cups 30*a*, 30*b*, 30*c*, 30*d*.

As illustrated in FIGS. 1 and 3, in the mounting surface 20 of the first side wall 16, the closing portion 32*a*, 32*b*, 32*c*, 32*d* of the injector cup 30*a*, 30*b*, 30*c*, 30*d* is placed near a boundary with the upper-side curved portion 15*a*, that is, near an upper end of the mounting surface 20. Further, the opening portion 33*a*, 33*b*, 33*c*, 33*d* of the injector cup 30*a*, 30*b*, 30*c*, 30*d* is placed below a bottom end of the mounting surface 20 of the first side wall 16. As such, in the present embodiment, the injector cup 30*a*, 30*b*, 30*c*, 30*d* extends below the bottom end of the mounting surface 20 of the first side wall 16 from around the upper end thereof. Here, the upper end is one example of a second end, and the bottom end is one example of a first end. The peripheral wall 31*a*, 31*b*, 31*c*, 31*d* of the injector cup 30*a*, 30*b*, 30*c*, 30*d* abuts with a part from a position near the upper end of the mounting surface 20 to the bottom end thereof, and a whole region of this abutment part is brazed to the mounting surface 20 with copper. That is, as illustrated in FIG. 1, when a virtual line placed at a center between the upper end and the bottom end in the mounting surface 20 is assumed a centerline C, the injector cup 30*a*, 30*b*, 30*c*, 30*d* extends to the bottom end from a position closer to the upper end than the centerline C, and a whole abutment region with the mounting surface 20 is fixed to the mounting surface 20.

Note that, at the time when the injector is fixed to the injector cup 30*a*, 30*b*, 30*c*, 30*d*, the injector is inserted therein from the opening portion 33*a*, 33*b*, 33*c*, 33*d* of the injector cup 30*a*, 30*b*, 30*c*, 30*d*, and a part between the injector cup 30*a*, 30*b*, 30*c*, 30*d* and the injector is sealed by a sealing member such as an O-ring. Then, the fuel inside the fuel pipe 10 is supplied to the injector via the through-hole of the mounting surface 20 and the through-hole formed in the peripheral wall 31*a*, 31*b*, 31*c*, 31*d* of the injector cup 30*a*, 30*b*, 30*c*, 30*d*.

Further, as illustrated in FIG. 1, the first bracket 40*a* and the second bracket 40*b* are attached to the mounting surface 20 of the first side wall 16 of the fuel pipe 10. The first bracket 40*a* is attached to a part closer to the first injector cup 30*a* between the first injector cup 30*a* and the second injector cup 30*b*. Further, the second bracket 40*b* is attached to a part closer to the third injector cup 30*c* between the third injector cup 30*c* and the fourth injector cup 30*d*. Each bracket 40*a*, 40*b* has a "U" shape in a front view, and includes a fixed portion 41*a*, 41*b* placed on a lower side and fixed to the internal combustion engine, a first extension portion 42*a*, 42*b* extending upward from one end of the fixed portion 41*a*, 41*b*, and a second extension portion 44*a*, 44*b* extending upward from the other end of the fixed portion 41*a*, 41*b*. The first extension portion 42*a*, 42*b* is provided with a rib portion 43*a*, 43*b* bent to extend outside the "U" shape of the bracket 40*a*, 40*b* in the front view. Further, the second extension portion 44*a*, 44*b* is provided with a rib portion 45*a*, 45*b* bent to extend outside the "U" shape of the bracket 40*a*, 40*b* in the front view. Vertical lengths of the first extension portion 42*a*, 42*b* and the second extension portion 44*a*, 44*b* are the same and longer than the vertical length of the first side wall 16 of the fuel pipe 10. Further, a vertical length of the rib portion 43*a*, 43*b*, 45*a*, 45*b* is slightly shorter than the vertical length of the first side wall 16.

As illustrated in FIGS. 1 and 4, upper ends of the first extension portion 42*a*, 42*b* and the second extension portion 44*a*, 44*b* of the bracket 40*a*, 40*b* are placed near a boundary with the upper-side curved portion 15*a* in the mounting surface 20 of the first side wall 16, that is, near the upper end of the mounting surface 20. Further, the fixed portion 41*a*, 41*b* of the bracket 40*a*, 40*b* is placed below the bottom end of the mounting surface 20 of the first side wall 16. The rib portion 43*a*, 43*b*, 45*a*, 45*b* of the bracket 40*a*, 40*b* abuts with a part from around an upper end of the first side wall 16 to around a bottom end thereof, and a whole region of this abutment part, that is, a region from a position near the upper end of the mounting surface 20 to a position near the bottom end thereof is brazed to the mounting surface 20 with copper. As such, the bracket 40*a*, 40*b* extends from an upper side relative to the centerline C of the mounting surface 20 to the bottom end, and a whole abutment region of the rib portion 43*a*, 43*b*, 45*a*, 45*b* with the mounting surface 20 is fixed to the mounting surface 20.

Next will be described an operation of the fuel supply device 1 of the present embodiment by comparing the operation with an operation of a fuel supply device 50 of a comparative example illustrated in FIGS. 5 to 7. Initially described is the fuel supply device 50 of the comparative example with reference to FIGS. 5, 6.

Figure 5:
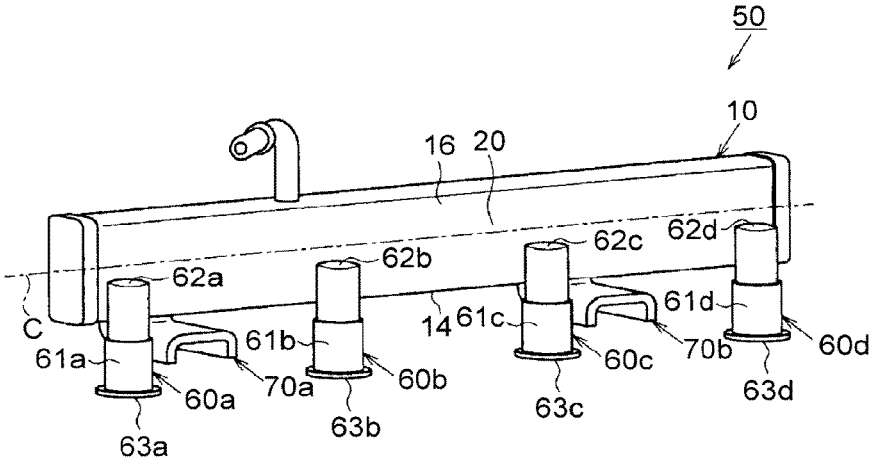
FIG. 5 is a perspective view of a fuel supply device of a comparative example.
Figure 6:
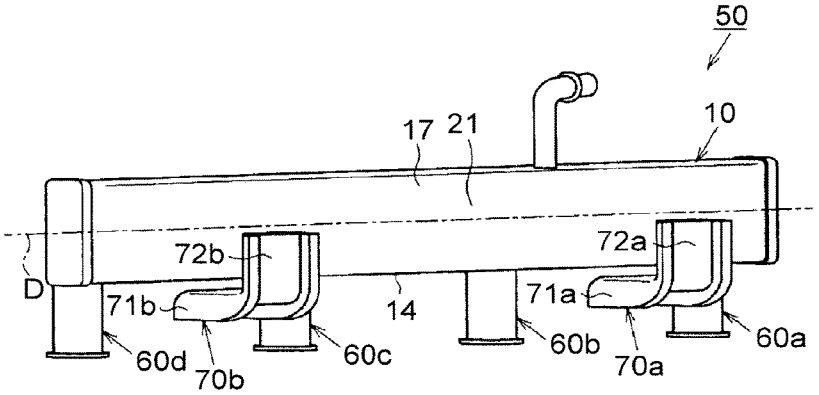
FIG. 6 is a perspective view of the fuel supply device of the comparative example.

As illustrated in FIGS. 5 and 6, the fuel supply device 50 of the comparative example includes a fuel pipe 10 having the same shape as the fuel pipe 10 in the fuel supply device 1 of the present embodiment. Accordingly, in the comparative example, the fuel pipe 10 is described with the use of the same reference signs. Further, the fuel supply device 50 of the comparative example includes four injector cups 60*a*, 60*b*, 60*c*, 60*d* and two brackets 70*a*, 70*b*.

As illustrated in FIG. 5, in the fuel supply device 50 of the comparative example, each injector cup 60*a*, 60*b*, 60*c*, 60*d* has a generally bottomed tubular shape. One end of a generally cylindrical peripheral wall 61*a*, 61*b*, 61*c*, 61*d* thereof is a closing portion 62*a*, 62*b*, 62*c*, 62*d* that is closed, and the other end thereof has an opening portion 63*a*, 63*b*, 63*c*, 63*d* that is opened. The injector cup 60*a*, 60*b*, 60*c*, 60*d* is attached such that a through-hole formed in a peripheral wall 61*a*, 61*b*, 61*c*, 61*d* corresponds to a corresponding one of four through-holes in a first side wall 16. An axial length of the peripheral wall 61*a*, 61*b*, 61*c*, 61*d* of the injector cup 60*a*, 60*b*, 60*c*, 60*d* is generally the same as a vertical length of the first side wall 16.

As illustrated in FIG. 5, in a mounting surface 20 of the first side wall 16, the closing portion 62*a*, 62*b*, 62*c*, 62*d* of the injector cup 60*a*, 60*b*, 60*c*, 60*d* is placed below a centerline C of the mounting surface 20. Further, the opening portion 63*a*, 63*b*, 63*c*, 63*d* of the injector cup 60*a*, 60*b*, 60*c*, 60*d* is placed below a bottom end of the mounting surface 20 of the first side wall 16. That is, in the fuel supply device 50 of the comparative example, the injector cup 60*a*, 60*b*, 60*c*, 60*d* extends below the bottom end of the mounting surface 20 from a position on a bottom-end side relative to the centerline C of the mounting surface 20. In the fuel supply device 50 of the comparative example, the peripheral wall 61*a*, 61*b*, 61*c*, 61*d* of the injector cup 60*a*, 60*b*, 60*c*, 60*d* abuts with the mounting surface 20 from a part near the centerline C and on a bottom-end side relative to the centerline C in the mounting surface 20 to the bottom end thereof, and a whole region of this abutment part is brazed to be fixed to the mounting surface 20. That is, in the fuel supply device 50 of the comparative example, the injector cup 60*a*, 60*b*, 60*c*, 60*d* is fixed only to a part on the bottom-end side relative to the centerline C in the mounting surface 20, and is not fixed to an upper-end side relative to the centerline C in the mounting surface 20.

Further, as illustrated in FIG. 6, in the fuel supply device 50 of the comparative example, the first bracket 70*a* and the second bracket 70*b* are attached to a surface 21 of a second side wall 17 of the fuel pipe 10. Each bracket 70*a*, 70*b* has a shape obtained by bending a flat plate into an "L" shape, and includes a fixed portion 71*a*, 71*b* placed below a bottom wall 14 of the fuel pipe 10 and fixed to an internal combustion engine, and an extension portion 72*a*, 72*b* bent continuously with the fixed portion 71*a*, 71*b*. When a virtual line placed at a center between an upper end and an bottom end of the surface 21 of the second side wall 17 is assumed a centerline D, the first bracket 70*a* is attached such that the extension portion 72*a* is brazed to a part below the centerline D and corresponding to a part of the first side wall 16 between the first injector cup 60*a* and the second injector cup 60*b*. Further, the second bracket 70*b* is attached such that the extension portion 72*b* is brazed to a part below the centerline D in the surface 21 of the second side wall 17 and corresponding to a part of the first side wall 16 between the third injector cup 60*c* and the fourth injector cup 60*d*. That is, in the fuel supply device 50 of the comparative example, the brackets 70*a*, 70*b* are fixed to the surface 21 of the second side wall 17, but not fixed to the first side wall 16.

In the fuel supply device 50 of the comparative example configured as described above and the fuel supply device 1 of the present embodiment, respective operations at the time when a fuel pressure inside the fuel pipe 10 fluctuates will be described with the use of operation results by simulation. Table 1 shows respective operation results of a maximum displacement amount and a volume change amount of an injector cup by simulation in the present embodiment and the comparative example. Note that Table 1 shows the operation results in a case where the fuel pipe 10 is configured such that a plate thickness is 1.2 mm, a vertical length is 36 mm, a depth is 16 mm, and a lateral length is 321.4 mm (a lateral length including a cap is 326 mm), and the injector cup is configured such that a plate thickness is 1 mm, an inside diameter is 13.5 mm, and a gap between central axes of adjacent injector cups in the mounting surface 20 is 97 mm.

Figure 7:
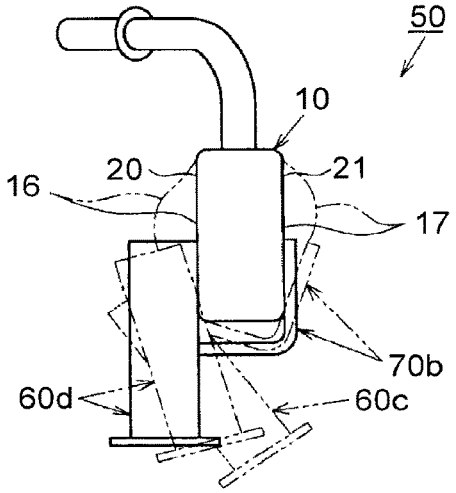
FIG. 7 is a side view of the fuel supply device in the comparative example at the time when a fuel pressure inside a fuel pipe increases.

As illustrated in FIG. 7, in the fuel supply device 50 of the comparative example, when the fuel pressure inside the fuel pipe 10 increases, an upper part in the first side wall 16 of the fuel pipe 10 expands outward as indicated by an alternate long and two short dashes line. As such, when the upper part, in the first side wall 16, to which the injector cup 60*a*, 60*b*, 60*c*, 60*d* is not fixed expands outward, a part of the injector cup 60*a*, 60*b*, 60*c*, 60*d* on a side closer to the closing portion 62*a*, 62*b*, 62*c*, 62*d* is also displaced toward an outer side of the fuel pipe 10 along with deformation of the first side wall 16. Hereby, as illustrated in FIG. 7, the injector cup 60*a*, 60*b*, 60*c*, 60*d* is displaced so as to pivot around the bottom end of the first side wall 16 as indicated by an alternate long and two short dashes line. As shown in Table 1, a maximum displacement amount among the four injector cups 60*a*, 60*b*, 60*c*, 60*d* was 400 μm by simulation. When the injector cup 60*a*, 60*b*, 60*c*, 60*d* is displaced as such, a relative position between the injector cup 60*a*, 60*b*, 60*c*, 60*d* and the injector inserted into the injector cup 60*a*, 60*b*, 60*e*, 60*d* in a fixed manner is changed. This may cause such a situation that a sealing characteristic of a sealing member provided between the injector cup 60*a*, 60*b*, 60*c*, 60*d* and the injector decreases.

TABLE 1

| | Maximum Displacement Amount (μm) | Volume Change Amount (cc/MPa) |
|---|---|---|
| Present Embodiment | 25 | 1.8 |
| Comparative Example | 400 | 1.4 |

Further, since the bracket 70*a*, 70*b* is fixed to a lower part relative to the centerline D in the surface 21 of the second side wall 17, when the fuel pressure inside the fuel pipe 10 increases, an upper part of the second side wall 17 expands outward as indicated by an alternate long and two short dashes line, but the lower part to which the bracket 70*a*, 70*b* is fixed is hard to expand. Since the second side wall 17 does not deform to expand outward in a whole region from its upper end to its bottom end, when the fuel pressure inside the fuel pipe 10 increases, the second side wall 17 cannot restrain a pressure fluctuation sufficiently. Accordingly, as shown in Table 1, a volume change amount at the time when the pressure inside the fuel pipe 10 fluctuated by 1 MPa was 1.4 cc by simulation.

Figure 8:
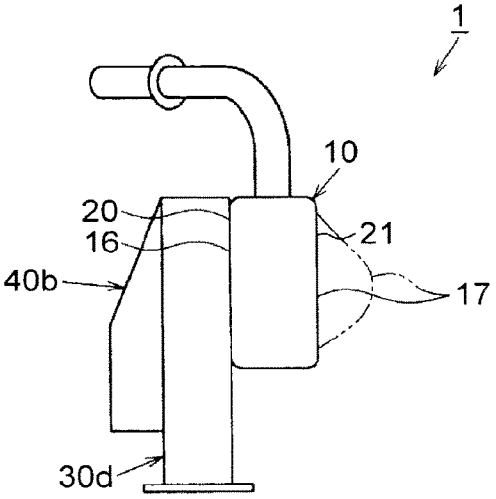
FIG. 8 is a side view of the fuel supply device in the embodiment at the time when a fuel pressure inside a fuel pipe increases.

In the meantime, in the fuel supply device 1 of the present embodiment, when the pressure in the fuel pipe 10 increases and the pressure is applied so as to press the side walls 12*a*, 13*a*, 14, 15, 16, 17 outward, the fuel pipe 10 deforms as illustrated in FIG. 8.

That is, as illustrated in FIG. 8, in the fuel supply device 1 of the present embodiment, the peripheral wall 31*a*, 31*b*, 31*c*, 31*d* of the injector cup 30*a*, 30*b*, 30*c*, 30*d* is brazed to the mounting surface 20 of the first side wall 16 of the fuel pipe 10 from around the upper end of the mounting surface 20 to the bottom end thereof. Furthermore, the rib portion 43*a*, 43*b*, 45*a*, 45*b* of the bracket 40*a*, 40*b* is brazed to a part from around the upper end of the mounting surface 20 of the first side wall 16 of the fuel pipe 10 to around the bottom end thereof. On that account, in the first side wall 16, a part, from around the upper end to the bottom end, to which the injector cup 30*a*, 30*b*, 30*c*, 30*d* and the bracket 40*a*, 40*b* are fixed has a high rigidity. Hereby, even if the fuel pressure inside the fuel pipe 10 increases, the first side wall 16 rarely deforms, thereby restraining displacement of the injector cup 30*a*, 30*b*, 30*c*, 30*d*. Accordingly, as shown in Table 1, a maximum displacement amount among the four injector cups 30*a*, 30*b*, 30*c*, 30*d* was 25 μm by simulation, and it is found that the displacement of the injector cup 30*a*, 30*b*, 30*c*, 30*d* is largely restrained as compared with the comparative example.

In the meantime, as illustrated in FIG. 8, since the injector cup 30*a*, 30*b*, 30*c*, 30*d* and the bracket 40*a*, 40*b* are not attached to the second side wall 17, when the above pressure is applied thereto, the whole second side wall 17 deforms to project outward as indicated by an alternate long and two short dashes line, thereby restraining a pressure fluctuation. Accordingly, as shown in Table 1, a volume change amount at the time when the pressure inside the fuel pipe 10 in the fuel supply device 1 fluctuated by 1 MPa was 1.8 cc by simulation, which is larger than the volume change amount at the time when the pressure fluctuation occurs in the comparative example. Consequently, it is possible to restrain pulsation due to the pressure fluctuation.

As described above, according to the above embodiment, it is possible to yield the following effects. In the fuel supply device 1 of the present embodiment, the fuel pipe 10 includes the first side wall 16 having the mounting surface 20 to which the injector cup 30*a*, 30*b*, 30*c*, 30*d* and the bracket 40*a*, 40*b* are attached. The peripheral wall 31*a*, 31*b*, 31*c*, 31*d* of the injector cup 30*a*, 30*b*, 30*c*, 30*d* extends at least from a position on a bottom-end side relative to the centerline C in the mounting surface 20 to a position on an upper-end side relative to the centerline C, and are also fixed to a part of the mounting surface 20 on the bottom-end side relative to the centerline C and a part on the upper-end side thereof relative to the centerline C.

In a case where the fuel pressure inside the fuel pipe 10 increases, a force is applied so as to deform the first side wall 16 and the second side wall 17 to swell outward. Here, in a case where no member is attached to the first side wall 16, a central part of the first side wall 16, that is, a part corresponding to the centerline C in the mounting surface 20 easily swells largely due to the force. In this regard, in the present embodiment, the part, in the first side wall 16, to which the injector cup 30*a*, 30*b*, 30*c*, 30*d* is fixed is reinforced by the injector cup 30*a*, 30*b*, 30*c*, 30*d*. Hereby, it is possible to restrain the swelling of the central part, in the first side wall 16, which easily swells largely at the time when the fuel pressure increases. Further, since the bracket 40*a*, 40*b* is attached to the mounting surface 20 of the first side wall 16, it is possible to increase a rigidity of the part, in the first side wall 16, to which the bracket 40*a*, 40*b* is fixed. This also makes it possible to restrain the deformation of the first side wall 16. Thus, according to the above configuration, since it is possible to restrain the deformation of the first side wall 16, it is possible to restrain the displacement of the injector cup 30*a*, 30*b*, 30*c*, 30*d* attached to the mounting surface 20 of the first side wall 16.

Further, in the fuel supply device 1 of the present embodiment, the fuel pipe 10 includes the second side wall 17 to which the injector cup 30*a*, 30*b*, 30*c*, 30*d* and the bracket 40*a*, 40*b* are not attached and which elastically deforms at the time when the fuel pressure is applied thereto. Accordingly, the rigidity of the second side wall 17 is lower than in a case where the bracket 40*a*, 40*b* and the injector cup 30*a*, 30*b*, 30*c*, 30*d* are not attached to the second side wall 17. Hereby, in a case where the fuel pressure inside the fuel pipe 10 increases, the second side wall 17 can deform so as to swell outward and damp the pulsation due to the pressure fluctuation of the fuel.

In the fuel supply device 1, the peripheral wall 31*a*, 31*b*, 31*c*, 31*d* of the injector cup 30*a*, 30*b*, 30*c*, 30*d* extends at least from a position closer to the upper end than the centerline C in the mounting surface 20 to the bottom end, and is fixed to the mounting surface 20 such that a whole abutment region thereof with the mounting surface 20 is brazed to the mounting surface 20. Hereby, in a part in which the injector cup 30*a*, 30*b*, 30*c*, 30*d* is attached to the mounting surface 20, the rigidity of the part in the first side wall 16 from the bottom end of the mounting surface 20 to around the upper end thereof can be increased. Accordingly, in a case where the fuel pressure inside the fuel pipe 10 increases, it is possible to further preferably restrain the first side wall 16 from swelling outward. Hereby, it is possible to further preferably restrain the displacement of the injector cup 30*a*, 30*b*, 30*c*, 30*d*.

In the fuel supply device 1, the bracket 40*a*, 40*b* extends at least from a position on a bottom-end side relative to the centerline C in the mounting surface 20 to a position on an upper-end side relative to the centerline C, and is also fixed to the mounting surface 20 at a part of the mounting surface 20 on the bottom-end side relative to the centerline C and at a part thereof on the upper-end side relative to the centerline C. Hereby, the part, in the first side wall 16, to which the bracket 40*a*, 40*b* is fixed can be reinforced by the bracket 40*a*, 40*b*. Hereby, a central part, of the first side wall 16, which easily swells largely at the time when the fuel pressure inside the fuel pipe 10 increases can be restrained more preferably. Accordingly, it is possible to more preferably restrain the displacement of the injector cup 30*a*, 30*b*, 30*c*, 30*d* attached to the mounting surface 20 of the first side wall 16.

In the fuel supply device 1, the bracket 40*a*, 40*b* extends at least from a position closer to the upper end than the centerline C in the mounting surface 20 to the bottom end, and is fixed to the mounting surface 20 such that a whole abutment region thereof with the mounting surface 20 is brazed to the mounting surface 20. Hereby, in a part in which the bracket 40*a*, 40*b* is attached to the mounting surface 20, the rigidity of the part in the first side wall 16 from the bottom end of the mounting surface 20 to around the upper end thereof can be increased. Accordingly, even if the fuel pressure inside the fuel pipe 10 increases, it is possible to further preferably restrain the first side wall 16 from swelling outward. This accordingly makes it possible to further preferably restrain the displacement of the injector cup 30*a*, 30*b*, 30*c*, 30*d*.

In the fuel pipe 10 of the fuel supply device 1, the first side wall 16 and the second side wall 17 among the flat side walls 12*a*, 13*a*, 14, 15, 16, 17 are side walls having a largest surface area exposed outside the fuel pipe 10. In a case where the rigidity of the side walls having such a large area is low, when the pressure inside the fuel pipe 10 increases, a deformation amount easily increases. In this regard, in the present embodiment, the injector cup 30*a*, 30*b*, 30*c*, 30*d* and the bracket 40*a*, 40*b* are attached to the mounting surface 20 of the first side wall 16 in which the deformation amount easily increases. Accordingly, when the injector cup 30*a*, 30*b*, 30*c*, 30*d* and the bracket 40*a*, 40*b* are fixed to the mounting surface 20 of the first side wall 16 in the aforementioned manner, it is possible to more markedly yield the effect of restraining the deformation of the first side wall 16.

Note that the fuel supply device is not limited to the configuration exemplified as above, but can be implemented in the following manner by modifying this appropriately, for example. Further, the following modifications can be combined appropriately and applied to the above embodiment if they can be combined.

In the fuel supply device 1 of the above embodiment, the rib portion 43*a*, 43*b*, 45*a*, 45*b* of the bracket 40*a*, 40*b* is brazed to a part from around the upper end of the mounting surface 20 of the first side wall 16 to around the bottom end thereof. However, the bracket 40*a*, 40*b* may extend at least from a position on the bottom-end side relative to the centerline C in the mounting surface 20 to a position on the upper-end side relative to the centerline C, and may be brazed to a part on the upper-end side relative to the centerline C and a part on the bottom-end side relative to the centerline C. Further, the number of brackets 40*a*, 40*b* is not limited to two, but may be one or may be three or more.

Further, as long as the bracket 40*a*, 40*b* is fixed to the mounting surface 20 of the first side wall 16, a shape of the bracket 40*a*, 40*b*, a fixed part thereof in the mounting surface 20, and a fixation method thereof are not limited to the aspect exemplified in the above embodiment.

In the fuel supply device 1 of the above embodiment, the injector cup 30*a*, 30*b*, 30*c*, 30*d* is brazed from around the upper end to the bottom end in the mounting surface 20 of the first side wall 16. However, the peripheral wall 31*a*, 31*b*, 31*e*, 31*d* of the injector cup 30*a*, 30*b*, 30*c*, 30*d* may extend at least from a position on the bottom-end side relative to the centerline C in the mounting surface 20 to a position on the upper-end side relative to the centerline C, and may be brazed to a part of the mounting surface 20 on the upper-end side relative to the centerline C and a part thereof on the bottom-end side relative to the centerline C. Further, in a case where the peripheral wall 31*a*, 31*b*, 31*c*, 31*d* of the injector cup 30*a*, 30*b*, 30*c*, 30*d* is fixed to the part on the upper-end side relative to the centerline C and the part on the bottom-end side relative to the centerline C, they may be fixed by brazing a continuous part including the centerline C, or may be fixed by brazing a plurality of parts at predetermined intervals. Further, the fixation method is not limited to the brazing exemplified in the above embodiment, but they may be fixed in other methods.

Further, the number of injector cups 30*a*, 30*b*, 30*c*, 30*d* is not limited to four, but can be changed according to the number of injectors provided in the internal combustion engine. Further, the shape of the injector cup 30*a*, 30*b*, 30*c*, 30*d* is not limited to a bottomed tubular shape or a tubular shape, and a specific shape or dimension is not limited to the aspect of the above embodiment. That is, the injector cup 30*a*, 30*b*, 30*c*, 30*d* should have a shape into which the injector can be accommodated.

In the fuel supply device 1 of the above embodiment, no member is fixed to the second side wall 17. However, if the second side wall 17 can deform to an extent that the second side wall 17 can damp the pressure fluctuation in the fuel pipe 10, a member other than the injector cup 30*a*, 30*b*, 30*c*, 30*d* and the bracket 40*a*, 40*b* may be attached to part of an outer peripheral wall of the second side wall 17.

In the fuel pipe 10 of the above embodiment, the first side wall 16 to which the injector cup 30*a*, 30*b*, 30*c*, 30*d* and the bracket 40*a*, 40*b* are attached is opposed to the second side wall 17 that deforms when the pressure inside the fuel pipe 10 increases. However, in the fuel pipe 10, the first side wall 16 to which the injector cup 30*a*, 30*b*, 30*c*, 30*d* and the bracket 40*a*, 40*b* are attached may not be opposed to the second side wall 17 that deforms when the pressure inside the fuel pipe 10 increases.

The fuel pipe 10 of the above embodiment is formed such that the tubular member 11 having a generally rectangular-solid shape is formed by pressing a cylinder, and both ends thereof are closed by the caps 12, 13. However, a formation method of the fuel pipe 10 is not limited to the above method. Further, a dimension of each part of the fuel pipe 10 is not limited to the value exemplified above. Further, the fuel pipe 10 may be configured such that no flat side wall is provided except the first side wall 16 and the second side wall 17 and the side walls other than the first side wall 16 and the second side wall 17 are curved. Further, the first side wall 16 and the second side wall 17 should be generally flat, and may partially include a recessed portion or a projection portion.

In the above embodiment, the injector cup 30*a*, 30*b*, 30*c*, 30*d* and the bracket 40*a*, 40*b* are attached to the mounting surface 20 of the first side wall 16. However, other members, a plate material to increase the rigidity of the first side wall 16, and the like may be fixed to the mounting surface 20.

Note that the above description is made on the basis of the directions in a state where the fuel supply device 1 is attached to the internal combustion engine. Accordingly, the bottom end and the upper end of the first side wall 16 may not necessarily be positioned on a bottom side and on an upper side in a state where the fuel supply device 1 is removed from the internal combustion engine.

What is claimed is:

1. A fuel supply device for an internal combustion engine, the fuel supply device comprising:

a fuel pipe configured to lead, to an injector, fuel introduced into the fuel pipe;

an injector cup into which the injector is inserted, the injector cup including a peripheral wall; and a bracket configured to fix the fuel pipe to the internal combustion engine, the fuel pipe including a first side wall and a second side wall, the first side wall including a mounting surface to which the injector cup and the bracket are attached, and the second side wall being configured such that the injector cup and the bracket are not attached, the second side wall being configured to elastically deform when a pressure of the fuel is applied to the second side wall, the bracket includes a pair of rib portions attached to the mounting surface, a pair of extension portions respectively attached to the pair of rib portions and extending in an axial direction of the injector cup, and a fixed portion between respective ends of the pair of extension portions, the fixed portion configured to be attached to the internal combustion engine, the rib portions extend away from the extension portions in a direction perpendicular to the axial direction of the injector cup and the extension portions are perpendicular to the mounting surface, the mounting surface including a first end, a second end, and a centerline, the first end and the second end being one end and an opposite end of the mounting surface in the axial direction of the injector cup, the centerline being a virtual line placed at a center between the first end and the second end, and the injector cup being configured such that the peripheral wall extends at least from a position on a first-end side relative to the centerline in the mounting surface to a position on a second-end side relative to the centerline, and the peripheral wall is fixed to the mounting surface at a part of the mounting surface on the first-end side relative to the centerline and at a part of the mounting surface on the second-end side relative to the centerline.

2. The fuel supply device according to claim 1, wherein:

the peripheral wall of the injector cup extends on the mounting surface from a position closer to the second end to the centerline than from the first end to the centerline; and the peripheral wall is configured to be fixed to the mounting surface over a whole region of an abutment part of the peripheral wall with the mounting surface.

3. The fuel supply device according to claim 1, wherein:

the bracket extends at least from the position on the first-end side relative to the centerline in the mounting surface to the position on the second-end side relative to the centerline; and the bracket is configured to be fixed to the mounting surface at the part of the mounting surface on the first-end side relative to the centerline and at the part of the mounting surface on the second-end side relative to the centerline.

4. The fuel supply device according to claim 3, wherein:

the bracket extends from a position closer to the second end to the centerline than from the first end to the centerline in the mounting surface; and the bracket is configured to be fixed to the mounting surface over a whole abutment region of the bracket with the mounting surface.

5. The fuel supply device according to claim 1, wherein:

the bracket has a U-shape.

6. The fuel supply device according to claim 1, wherein:

vertical lengths of the pair of extension portions are the same or longer than a vertical length of the first side wall.

* * * * *